US005519285A

United States Patent [19]

Ukegawa et al.

[11] Patent Number: 5,519,285

[45] Date of Patent: May 21, 1996

[54] ELECTRODELESS DISCHARGE LAMP

[75] Inventors: Shin Ukegawa; Shigeaki Wada; Atsunori Okada; Shingo Higashisaka; Miki Kotani; Motohiro Saimi; Taku Sumitomo; Osamu Kuramitu; Shinichi Aoki, all of Osaka, Japan

[73] Assignee: Matsushita Electric Works, Ltd., Osaka, Japan

[21] Appl. No.: 165,339

[22] Filed: Dec. 13, 1993

[30] Foreign Application Priority Data

| | | | |
|---|---|---|---|
| Dec. 15, 1992 | [JP] | Japan | 4-333984 |
| Dec. 15, 1992 | [JP] | Japan | 4-333985 |
| Dec. 15, 1992 | [JP] | Japan | 4-333986 |
| Dec. 15, 1992 | [JP] | Japan | 4-333987 |

[51] Int. Cl.[6] ..... H01J 65/04

[52] U.S. Cl. ..... 313/594; 313/601; 313/635; 313/634; 315/248

[58] Field of Search ..... 313/594, 601, 313/491, 635, 634; 315/248

[56] References Cited

U.S. PATENT DOCUMENTS

| | | | |
|---|---|---|---|
| 1,965,127 | 7/1934 | Marshall | 315/248 |
| 2,223,399 | 12/1940 | Bethenod . | |
| 3,170,086 | 1/1962 | Bell | 315/248 |
| 3,649,864 | 3/1972 | Willemsen | 313/635 |
| 4,206,387 | 6/1980 | Kramer et al. | 315/248 |
| 4,673,843 | 6/1987 | Okanuma | 313/635 |
| 4,701,664 | 10/1987 | Larue et al. | 313/489 |
| 4,727,294 | 3/1988 | Houkes et al. . | |
| 4,894,590 | 1/1990 | Witting | 315/248 |
| 4,902,937 | 2/1990 | Witting | 315/248 |
| 4,954,937 | 9/1990 | Kobayashi et al. | 362/255 |
| 4,959,592 | 9/1990 | Anderson | 315/248 |
| 4,982,140 | 1/1991 | Witting | 315/248 |
| 5,003,214 | 3/1991 | Morris et al. | 313/112 |
| 5,032,757 | 7/1991 | Witting . | |
| 5,057,750 | 10/1991 | Farrall et al. | 315/248 |
| 5,059,868 | 10/1991 | El-Hamamsy et al. | 315/248 |
| 5,084,654 | 1/1992 | El-Hamamsy et al. . | |
| 5,095,249 | 3/1992 | Roberts et al. . | |
| 5,140,227 | 8/1992 | Dakin et al. . | |
| 5,157,306 | 10/1992 | Witting . | |
| 5,183,602 | 2/1993 | Raj et al. | 252/587 |
| 5,220,243 | 6/1993 | Klinedinst et al. | 313/489 |
| 5,306,987 | 4/1994 | Dakin et al. . | |

FOREIGN PATENT DOCUMENTS

| | | | |
|---|---|---|---|
| 1159356 | 11/1989 | Japan | H01J 56/04 |

*Primary Examiner*—Donald J. Yusko
*Assistant Examiner*—Michael Day

[57] ABSTRACT

An electrodeless discharge lamp includes a discharge gas sealed in a lamp tube. The discharge gas includes a halide of rare earth metal. An auxiliary electrode is disposed on or adjacent to an outer periphery wall of the lamp tube such that the auxiliary electrode is capacitively coupled to an interior space of the lamp tube. A main induction coil is wound around the lamp tube and receives power from a first high frequency power source. The auxiliary electrode receives power from a second high frequency power source. In operation, the electrodeless discharge lamp attains smooth lighting upon starting or restarting.

7 Claims, 11 Drawing Sheets

ELECTRODELESS DISCHARGE LAMP

BACKGROUND OF THE INVENTION

This invention relates generally to an electrodeless discharge lamp and, more particularly, to a discharge lamp which does not include an electrode within a lamp tube and which causes an excitation luminescence (or plasma discharge) from discharging gases sealed within the lamp tube with an externally applied high frequency electromagnetic field.

The electrodeless discharge lamp of the kind referred to has been subjected to research and development for providing to the lamp such features as being small in size, high in the output, and long lasting, so as to be usefully employable as a high output point source of light.

DESCRIPTION OF RELATED ART

Conventional electrodeless discharge lamps may be arranged for the generation of a luminescence with the discharging gases in the lamp tube excited by a high frequency electromagnetic field. The high frequency electromagnetic field is generally initiated using an induction coil wound around the tube.

While an initial starting of such discharge lamp 25 is made relatively easy by an addition of mercury to the discharging gases sealed in the tube, a re-starting is made rather difficult. Further, there has been a problem, in particular, that a temperature rise in the lamp tube upon its lighting causes vapor pressure of mercury to vary in a manner of exponential function so as to be difficult to match with a high frequency power source for applying a high frequency current to the induction coil. Thus, the discharge lamp flickers out when the matching cannot take place. When a luminous substance like mercury is not added to the discharging gas, it becomes easier to match with the high frequency power source, but the gas pressure has to be made higher for obtaining a sufficient quantity of light, and the initial starting is thereby made difficult. While an application of a relatively high voltage to the induction coil may result in forcibly starting the lamp. The high voltage requires enlarged high frequency power source. Consequently, the entire electrodeless discharge lamp must be made larger.

In order to eliminate the above problem, there have been suggested in, for example, U.S. Pat. Nos. 4,894,590, 4,902, 937 and 4,982,140 to H. L. Witting, U.S. Pat. No 5,057,750 to G. A. Farrall et al, and U.S. Pat. No. 5,059,868 to S. A. El-Hamamsy et al various electrodeless discharge lamps having a starting means for executing a preliminary discharge in advance of and separately from a main discharge by means of a main induction coil.

In these known electrodeless discharge lamps, in general, an induced electric field is produced within the lamp tube by high frequency electromagnetic field, and a discharge plasma is caused to run along this induced electric field. While in this case, a state in which a preliminary discharge is made to take place by a starting means is shifted to the state in which the discharge plasma runs along the induced electric field, there has been a problem that a relatively large energy is required for the shifting of the plasma arc discharge to the state of running along the induced electric field, and the discharge lamp starting has been is practically uneasy to smoothly carry out.

In Japanese Patent Laid-Open Publication No. 5-217561 based on U.S. patent application Ser. No. 07/790,837 as the priority basis (though laid-open later than the date of priority claimed for the present invention), further, it is suggested to employ a halide of rare earth metal, in particular, neodymium, but this is effective to improve only the luminous color but is insufficient for improving the startability and the restartability.

SUMMARY OF THE INVENTION

Therefore, it is a primary object of the present invention to provide an electrodeless discharge lamp which has eliminated the foregoing problems and is capable of improving both the startability and restartability even when a discharging gas does not include mercury and even without a large high frequency power source.

According to the present invention, this object can be realized by an electrodeless discharge lamp in which a high frequency current is supplied from a first high frequency power source to an induction coil disposed on the exterior of a lamp tube of a light-transmitting material. The lamp tube contains a discharge gas sealed therein to generate an excitation luminescence (i.e., a plasma discharge when acted upon by a high frequency electromagnetic field. A preliminary discharge of the discharge gas in the lamp tube is generated by prior to the excitation luminescence or plasma discharge by means of the induction coil. The discharge gas includes a halide of rare earth metal. A foil type auxiliary electrode is disposed adjacent to an outer peripheral wall of the lamp tube at an axial position on one side of the lamp tube and capacitively coupled to an interior space of the lamp tube. A second high frequency power source supplies a power to the auxiliary electrode. The second high frequency power source is separate from the first high frequency power source.

All other objects and advantages of the present invention shall be made clear in the following description of the invention detailed with reference to preferred embodiments of the invention as shown in accompanying drawings.

Figure 1:
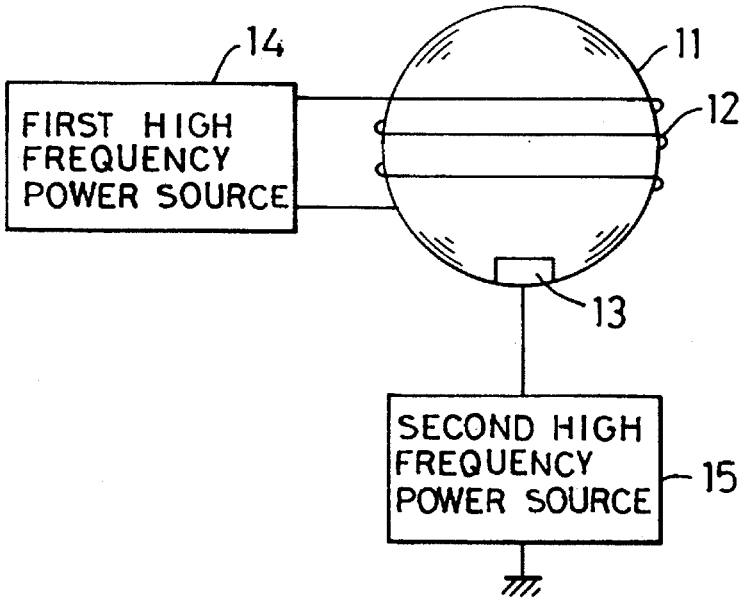
FIG. 1 shows in a schematic diagram an arrangement of the electrodelees discharge lamp in an embodiment according to the present invention, in which the discharge gas includes a halide of rare earth metal and, in addition to the induction coil and first high frequency power source for the coil, an auxiliary electrode and second high frequency power source for the electrode are provided.

While the present invention shall now be described in detail with reference to the respective embodiments shown in the drawings, it will be appreciated that the intention is not to limit the present invention only to these embodiments shown but rather to include all alterations, modifications and equivalent arrangements possible within the scope of appended claims.

DETAILED DESCRIPTION OF THE PREFERRED EMBODIMENTS

Referring to FIG. 1, there is shown an embodiment of the electrodeless discharge lamp according to the present invention, in which the electrodeless discharge lamp comprises a lamp tube 11 formed into a spherical shape preferably with such light-transmitting material as a silica glass or the like, and a discharge gas including a halide of rare earth metal, preferably a mixture gas of 100 Torr of xenon gas as a rare gas and 20 mg of neodymium iodide as a halide of neodymium is sealed within the tube 11. Peripherally around the lamp tube 11, there is wound an induction coil 12, and a single type auxiliary electrode 13 is provided to be adjacent to outer surface of the lamp tube 11. While the induction coil 12 is shown in FIG. 1 as wound in three turns, the number of coil turn is not required to be particularly limited but may only be required to be more than one turn. The auxiliary electrode 13 is formed with a metal foil into a square shape of each 10 mm side, for example, and is disposed in the present instance on one end side of an axial line of the induction coil 12, i.e. disposed at a location substantially the same distance from points around a turn of the induction coil.

A first high frequency power source 14 supplies a high frequency current to the induction coil 12 to generate a high frequency electromagnetic field.

The high frequency electromagnetic field acts upon the discharge gas within the lamp tube 11 and causes an excitation luminescence of the discharge gas (i.e. a plasma discharge) to occur within the lamp tube 11. As an induction electric field is generated within the lamp tube 11, plasma discharge (or excitation luminescence) occurs in the tube 11 and is formed into a toroidal shape. A high frequency voltage from a second high frequency power source is applied to the auxiliary electrode 13 to generate a string-shape preliminary discharge due to a high frequency electric field generated around the auxiliary electrode 13. In this case, the preliminary discharge is generated as the result of ionization of electrons accelerated by the high frequency electric field occurring around the auxiliary electrode 13 and caused to collide with atoms of the discharge gas. Since the auxiliary electrode 13 is of the single terminal type, the preliminary discharge is restricted only at one end by the auxiliary electrode 13, and the other end of the discharge is relatively freely shiftable. The first and second high frequency power sources 14 and 15 comprise respectively a high frequency generating section for a high frequency output, an amplifier section for a power amplification of the high frequency output, a matching section for matching an impedance of an amplified high frequency output of the amplification section with the induction coil 12 or with the auxiliary electrode 13, and so on. In practice, the second high frequency power source 15 applies the high frequency voltage across the auxiliary electrode 13 and an earth.

Figure 2A:
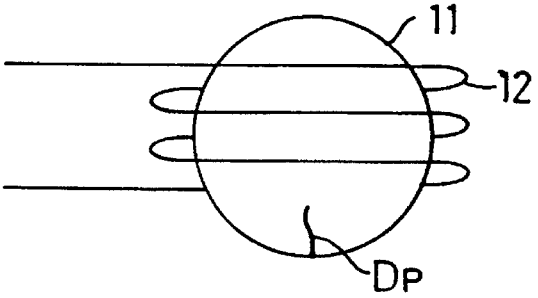
FIGS. 2A to 2D are explanatory views for the operation of the auxiliary electrode provided in the electrodeless discharge lamp of FIG. 1.
Figure 2C:
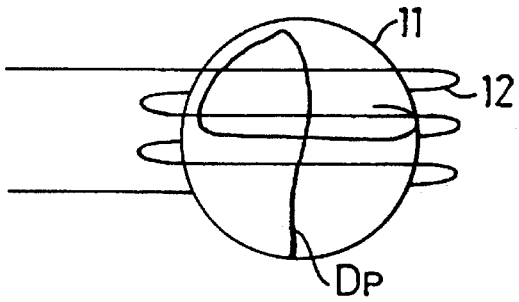
Figure 2B:
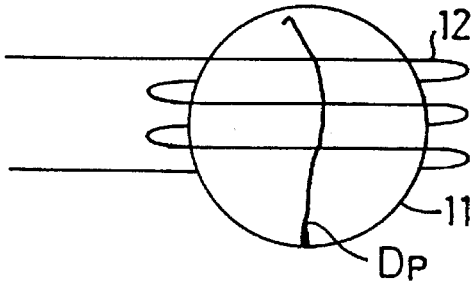
Figure 2D:
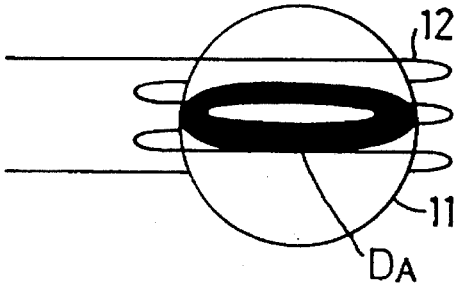

Now, in the electrodelees discharge lamp shown in FIG. 1, the high frequency voltage is applied from the second high frequency power source 15 across the auxiliary electrode 13 and the earth, and a preliminary discharge $D_p$ is thereby caused to occur inside the tube 11 nearby the auxiliary electrode 13, which discharge $D_p$ gradually grows to extent upward from the position of the auxiliary electrode 13 and reached the other end side of the tube 511, as shown in FIGS. 2A and 2B. Here, the high frequency current is fed to the induction coil 12 from the first high frequency power source 14, the extended free end of the preliminary discharge $D_p$ is induced to further extend along the induction electric field occurring due to the high frequency electromagnetic field generated around the induction coil 12, so as to form an annular discharge path as shown in FIG. 2C. As the annular discharge path is completed, the discharge shifts to a toroidal arc discharge $D_A$ as shown in FIG. 2D. Accordingly, a plasma discharge occurs. The plasma discharge generates a strong luminescence by exciting the discharge gas to achieve a lighting state. After shifting to the lighting state, the application of the high frequency voltage to the auxiliary electrode 13 becomes unnecessary.

In the above embodiments, the high frequency current has been supplied to the induction coil 12 after the occurrence of the preliminary discharge $D_p$. However, it is possible to supply the high frequency current to the induction coil 12 simultaneously with the application of the high frequency voltage to the auxiliary electrode 13. Further, the high frequency current may be increased after the occurrence of the preliminary discharge $D_p$. For the discharge gas, it is also possible to use a mixture gas containing another halide of rare earth metal. While the auxiliary electrode 13 has been disclosed as being formed by a square metal foil having 10 mm sides, the foil is not limited to any particular size, shape, or position.

It should be appreciated that, according to the foregoing electrodeless discharge lamp, the annular or continuous string-shaped preliminary discharge can be generated with the application of the high frequency voltage to the single type auxiliary electrode 13, and its shift to the electrodeless discharge $D_A$ is rendered easier. In addition, the use of the mixture gas of xenon and neodymium iodide as the discharge gas in conjunction with the significant action of the preliminary discharge at the starting enables the lighting in an extremely short time to readily take place. Further, with the use of this discharge gas, mainly neodymium attains the excitation luminescence (plasma discharge) during lighting while the vapor pressure of this neodymium is kept relatively low in the lighting state. Additionally, it is possible to instantaneously light the lamp, even when restarting the lamp immediately after the lamp has been turned off. In another working aspect of the electrodeless discharge lamp according to the present invention, a halide of cesium, such as cesium iodide, is admixed further with the mixture of xenon and neodymium iodide. With this mixture, the relatively low vapor pressure of neodymium during lighting can be raised to improve the luminescence efficiency of the discharge lamp. In the present embodiment, other constituents are the same as those in the embodiment of FIG. 1 except for the difference in the discharge gas.

Figure 3:
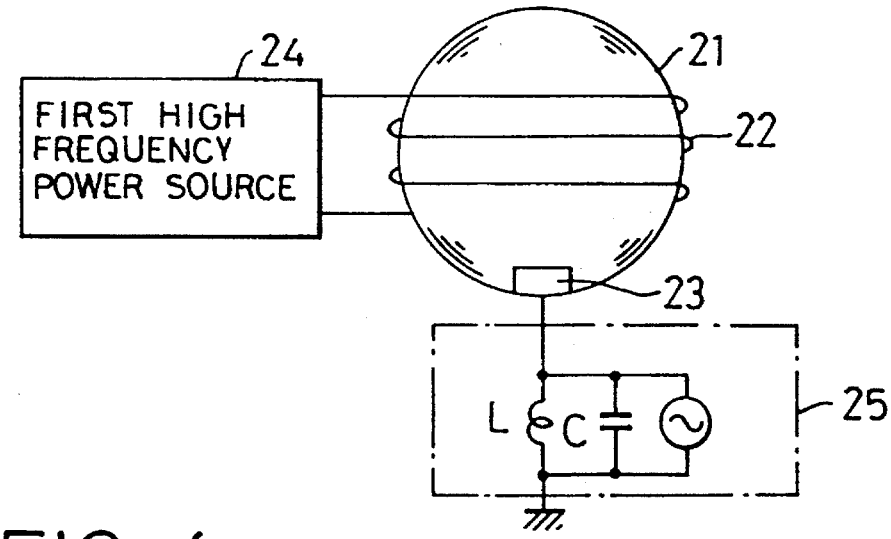
FIGS. 3 through 11 are schematic diagrams showing respective other embodiments of the electrodeless discharge lamp according to the present invention.

Another embodiment of the electrodeless discharge lamp of the present invention is shown in FIG. 3. In this embodiment, resonant circuit may be utilized to simplify the second high frequency power source 25. For example, the output section of the second high frequency power source 25 may include a parallel resonance circuit of an inductor L and capacitor C connected in parallel to each other. Alternatively, a series resonance circuit may alternatively be employed. In this embodiment, all other constituents are the same as those in the embodiment of FIG. 1, except for the arrangement at the output section of the second high frequency power source 25.

Figure 4:
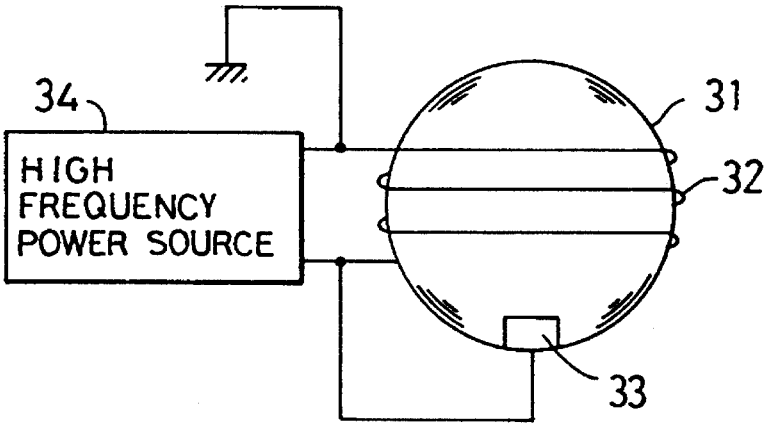

Referring to FIG. 4, an alternate embodiment of the electrodeless discharge lamp includes a high frequency power source 34 for supplying high frequency current to the induction coil 32 wound on the lamp tube 31. The induction coil 32 has one terminal connected to ground and the other terminal connected to the auxiliary electrode 33. In this configuration, the power source configuration can be simplified because the second high frequency power source is included in the first high frequency power source 34. In the embodiment shown in FIG. 4, all other constituents are the same as those in the embodiment of FIG. 1, except for the simpler arrangement of the high frequency power source.

Figure 5:
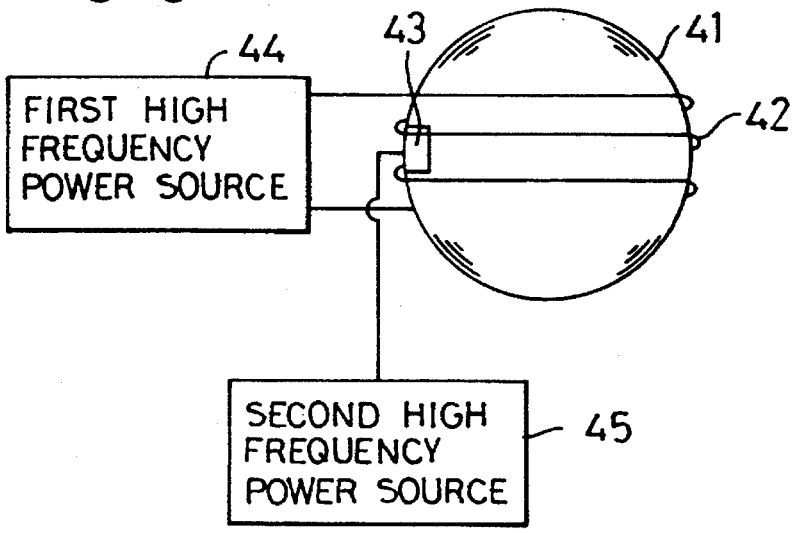

In the case of still another embodiment shown in FIG. 5 of the electrodeless discharge lamp according to the present invention, the auxiliary electrode 43 is energized by the second high frequency power source 45 which is separated from the first high frequency power source 44 connected to the induction coil 42. The auxiliary electrode is also disposed at winding position about the lamp tube 41 of the coil 42. According to this embodiment, the preliminary discharge $D_p$ ; is generated substantially in the same plane as a revolving plane of the arc discharge $D_A$, so that the shift of the discharging state from the preliminary discharge $D_p$ to the toroidal arc discharge $D_A$ is easier. Further, the power required to be input to the induction coil 42 to start the discharge lamp can be reduced from that required in the embodiment of FIG. 1. Except for the difference in the disposition of the auxiliary electrode 43, all other constituents in this embodiment are the same as those in the embodiment of FIG. 1.

Figure 6:
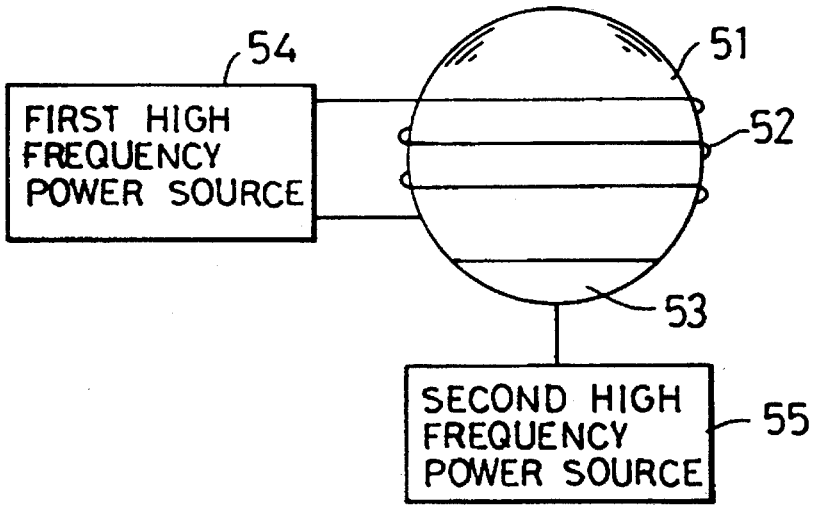

Another embodiment of the electrodeless discharge lamp is shown in FIG. 6. In this embodiment, the auxiliary electrode 53 is formed on the outer wall surface of the lamp tube 51 as a metal film by means of deposition or a similar process. In this metal deposition, it is advantageous to employ, for example, platinum. Platinum improved the degree of adhesion between the auxiliary electrode 53 and the lamp tube 51. In the embodiment shown in FIG. 1, a problem arises in that the metal foil of the auxiliary electrode may separate from the spherical outer wall surface of the lamp tube. Eventually, the metal foil may only contact the lamp tube at multiple points on the surface of the lamp tube. In this event, the high frequency electric field occurring around the auxiliary electrode may be insufficient with respect to the discharge gas. In the present embodiment, on the other hand, the degree of adhesion of the auxiliary electrode 53 with respect to the lamp tube 51 can be sufficiently elevated. Hence, the action of the high frequency electric field disposed about the auxiliary electrode 53 is sufficient to act upon the discharge gas. Accordingly, the preliminary discharge $D_p$ may be generated by a relatively low energy. Hence, the startability of the discharge lamp is improved. Further, the lamp tube 51 has improved heat retaining properties so that, when a luminous substance is mixed with the discharge gas, the vapor pressure of the luminous substance is elevated. The elevated vapor pressure causes an increase in the amount of luminescence and improves the input/output efficiency of the discharge lamp. The induction coil and first and second high frequency power sources, as well as all other constituents in this embodiment are the same as those in the foregoing embodiment of FIG. 1.

Figure 7:
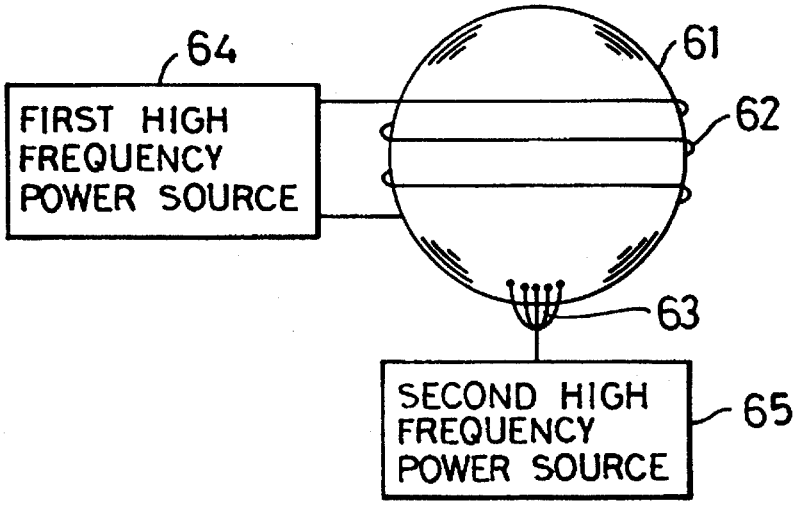

In a further embodiment shown in FIG. 7 of the 10 electrodeless discharge lamp according to the present invention, the auxiliary electrode 63 is formed by a bundle of thin metal wires in a brush shape. While the thin metal wires of the auxiliary electrode 63 only contact the lamp tube at a plurality of points, the plurality of points has a sufficiently high density to enhance the action of the high frequency electric field on the discharge gas to a level higher than that attainable with the metal foil auxiliary electrode of the embodiment shown in FIG. 1. In other words, the energy required for energizing the auxiliary electrode can be decreased without affecting the operation of the discharge lamp. In the instant embodiment, all other constituents including the lamp tube 61, induction coil 62 and first and second high frequency power sources and 65 are the same as those in the embodiment of FIG. 1.

Figure 8:
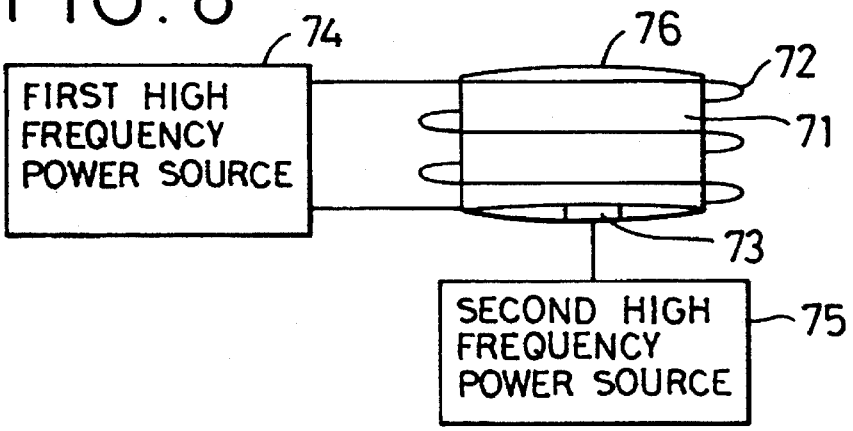

According to another embodiment shown in FIG. 8 of the electrodeless discharge lamp according to the present invention, the lamp tube 71 includes a cylindrical member and an induction coil 72 wound about a cylindrical periphery of the mender. An auxiliary electrode 73 is provided a first substantially flat axial end faces of the cylindrical member. A second substantially flat axial end face functions as a main luminescent light radiating surface 76. In the embodiment of FIG. 1 where the lamp tube is spherical, a problem may arise where the induced electric field occurring around the induction coil may not be sufficient to act on the free end of the preliminary discharge $D_p$ since the free end may extend out of the zone surrounded by the coil as shown in FIG. 2B. By contrast, the present embodiment the cylindrical lamp tube 71 reduces the distance from the auxiliary electrode 73 to the extended free end of the preliminary discharge $D_p$ which allows the electric field to more readily shift the preliminary discharge $D_p$ to the arc discharge $D_A$. Hence, startability of the discharge lamp can be improved. In the instant embodiment, all other constituents including the first and second high frequency power sources 74 and 75 are the same as those in the embodiment of FIG. 1.

Figure 9:
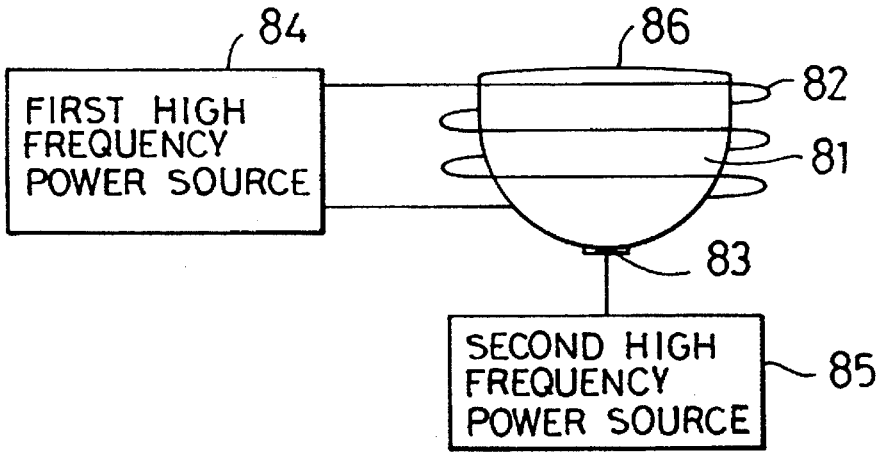

FIG. 9 shows another embodiment of the electrodeless discharge lamp where the lamp tube 81 has a substantially hemispherical shape. The hemispherical shaped lamp tube includes a substantially cylindrical central part on which the induction coil 82 is wound, a first spherical axial end surface on which the auxiliary electrode 83 is provided, and a second spherical axial end surface having a substantially flat shape and acting as the main luminescent light radiating surface 86. In this embodiment, all other constituents including the first and second high frequency power sources 84 and 85 are the same as those in the embodiment of FIG. 1 or 8.

Figure 10:
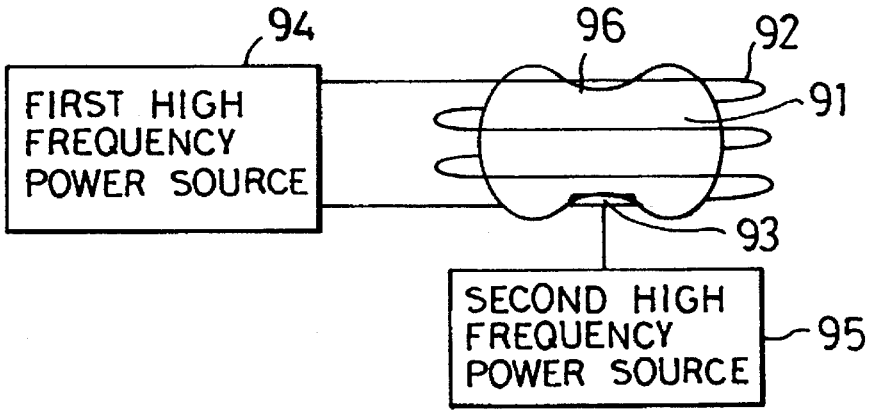

FIG. 10 shows another embodiment of the electrodeless discharge lamp where the lamp tube 91 is shaped as a half-compressed ball with a swelled periphery on which the induction coil 92 is wound, and two concave axial end surfaces. The auxiliary electrode 93 is provided on one concave end surface and the other concave end surface acts as the main luminescent surface 96. In this embodiment, all other constituents are the same as those in the embodiment of FIG. 1.

Figure 11:
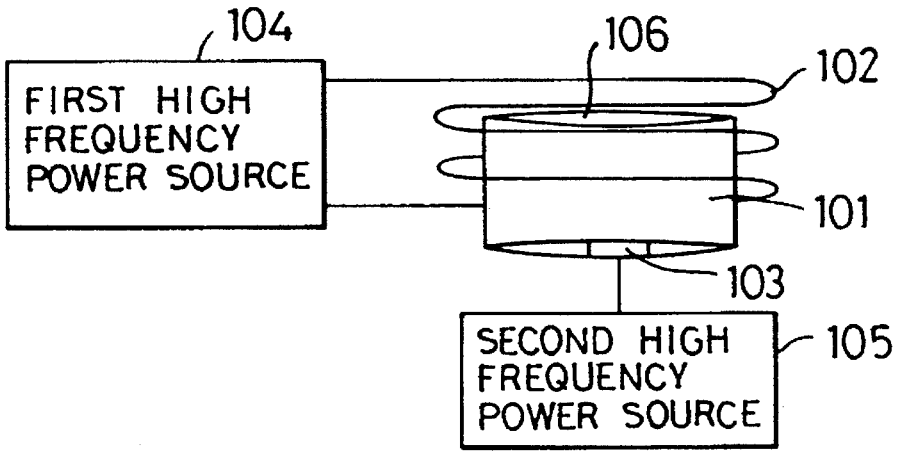
Figure 12:
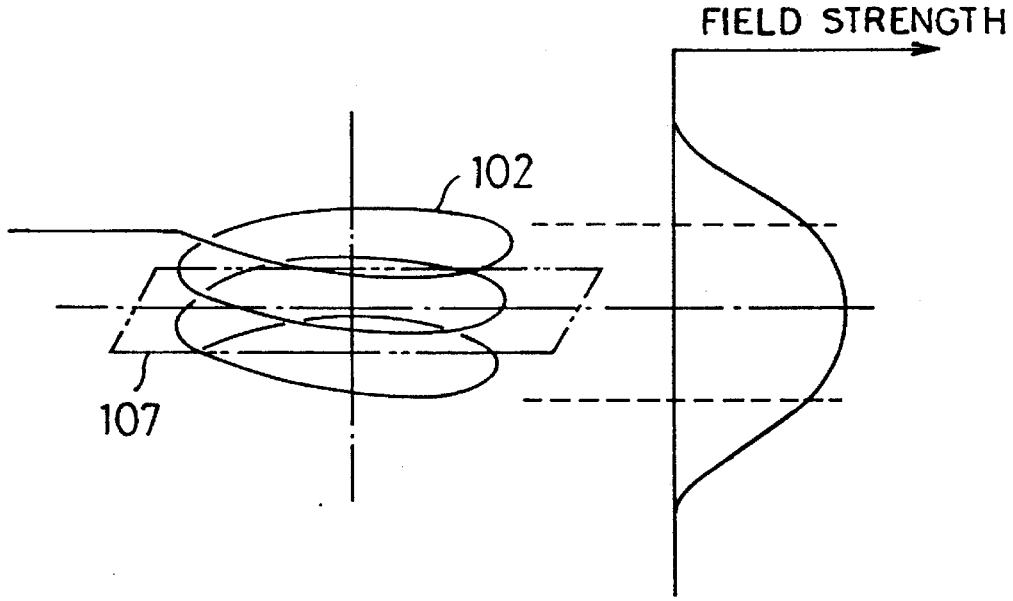
FIG. 12 is an explanatory view for the operation of the electrodeless discharge lamp in the embodiment of FIG. 11.

FIG. 11 shows another embodiment of the electrodeless discharge lamp. The embodiment shown in FIG. 11 is similar to the embodiment shown in FIG. 8, except that in FIG. 11 the cylindrically shaped lamp tube 101 is disposed offset from the induction coil 102. The auxiliary electrode 103 is disposed on a first axial end surface of the induction coil 102. A second axial end surface acts as the main luminescent light radiating surface 106 and is substantially aligned with a central plane intersecting at right angles the axial line of the coil 102. The intensity of the induction electric field due to the high frequency electromagnetic field generated around the induction coil 102 is largest in the central area of the induction coil 102 and smaller at both ends of the induction coil along the axial line. As shown in FIG. 12, the main luminescent light radiating surface 106 of the lamp tube 101 is substantially aligned with the central plane 107 intersecting at right angles the axial line of the induction coil 102. In this arrangement the strongest induction electric field acts upon the free end of the preliminary discharge $D_p$. Consequently, the shift of the discharge from the preliminary discharge $D_p$ to the toroidal arc discharge $D_A$ can be easily attained, and the startability of the discharge lamp can be further improved. In the present embodiment, all other constituents including the auxiliary electrode 103 and first and second high frequency power sources 104 and 105 are the same as those on the embodiment of FIG. 1.

Figure 13:
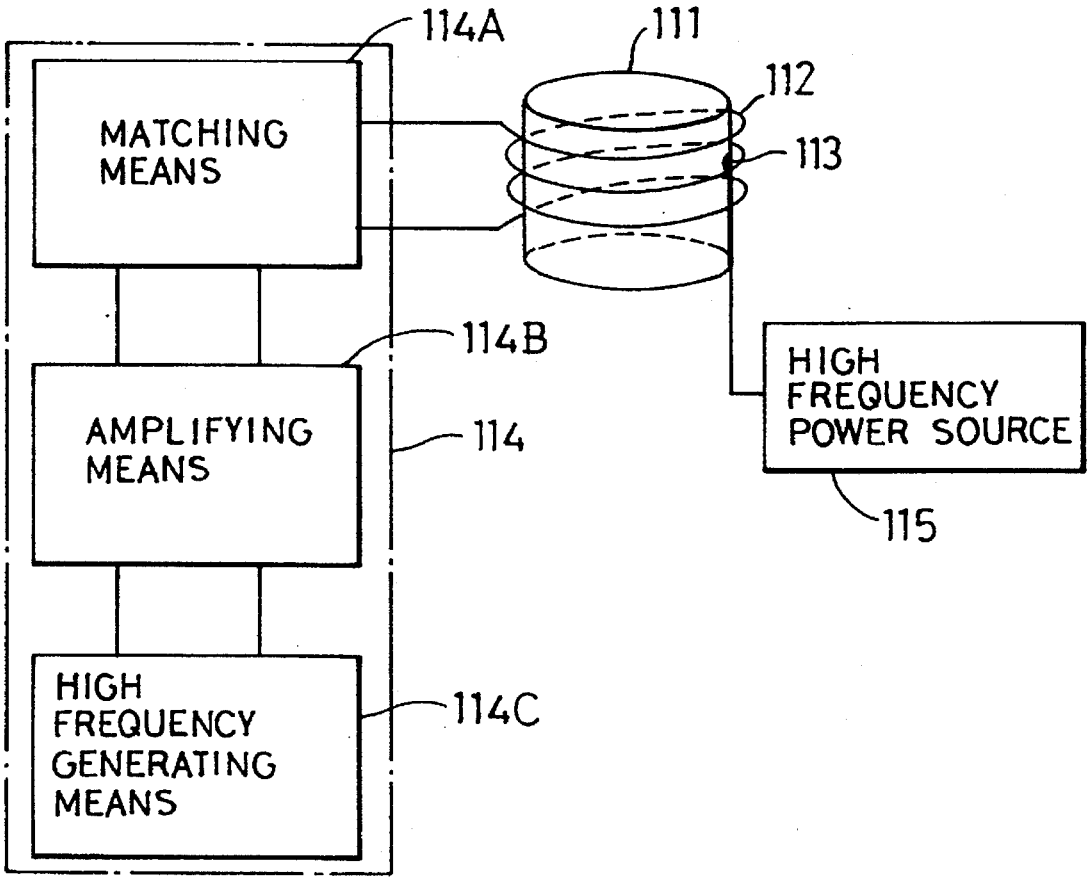
FIG. 13 shows in a schematic diagram an arrangement of the electrodeless discharge lamp in another 20 embodiment according to the present invention.

In FIG. 13, there is shown still another embodiment of the electrodeless discharge lamp according to the present invention, in which, while the main arrangement is similar to that in the foregoing embodiment of FIG. 9, the auxiliary electrode 113 in the present instance is formed by a circular copper foil of, for example, 6 mm. in diameter and disposed at the farthest position on the periphery of the cylindrical lamp tube 111 from power feeding points from the first high frequency power source 114 to the induction coil 112, in the winding area of the coil. In the first high frequency power source 114, there are included preferably a high frequency generating means 114C, amplifying means 114B for amplifying the high frequency output of the means 114C, and a matching means 114A for matching the impedance of the induction coil 112 or the auxiliary electrode 113.

Figure 14:
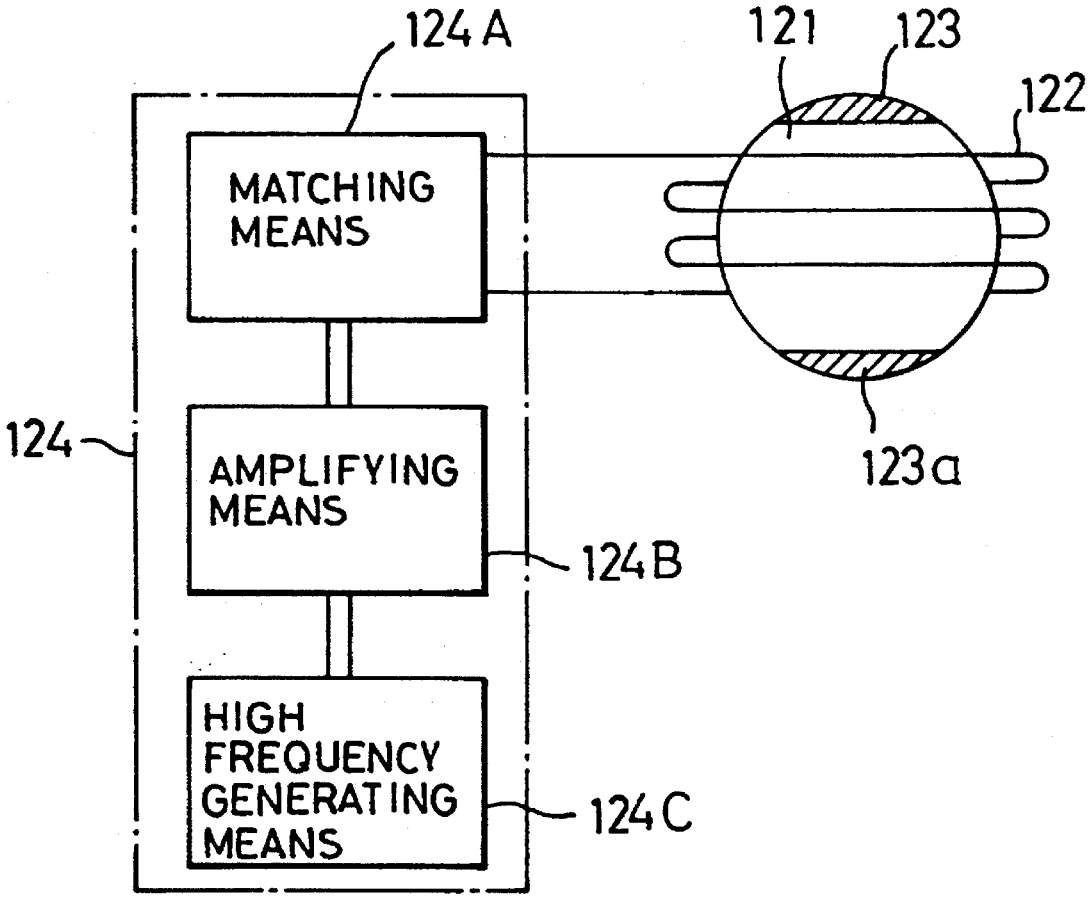
FIG. 14 is a schematic diagram of an arrangement of the electrodeless discharge lamp in still another embodiment of the present invention.

Application of a voltage from the second high frequency power source 115 to the auxiliary electrode 113 causes a preliminary discharge $D_p$. Subsequently, current supplied from the first high frequency power source 114 to the induction coil 112 causes an induction electric field to lie along the winding turns of the induction coil 112. Consequently, the preliminary discharge $D_p$ generated from the auxiliary electrode 113 is induced at the free end to extend along the induction electric field and annular discharge 117 as shown in FIG. 14 occurs. In this manner, the preliminary discharge is led towards the portion where the electric field intensity is the largest in the induction electric field.

In a further embodiment of the electrodeless discharge lamp according to the present invention as shown in FIG. 14, there are provided heat insulating films 123 and **123*a* on the outer periphery of the lamp tube 121 at its portions other than the zone around which the induction coil 122 is wound, if required, all over such other portions. The heat insulating films 123 and 123*a* may be formed with using a thin metal film known to be highly reflective with respect to infrared rays, such as platinum, gold or silver, or using a thin film coating highly reflective with respect to infrared rays while still having high light transmission properties. In the present instance, the high frequency power is supplied from the high frequency power source 124 to the induction coil 122. The excitation luminescence (plasma discharge) is generated by utilizing the induction coil 122 to expose the discharge gas to a high frequency electromagnetic field. The heat radiation of the lamp tube 121 is restrained by the presence of the heat insulating films 123 and 123*a*. Consequently, even the coldest portion of the lamp tube 121** will have a higher temperature as compared to lamp tubes where no heat insulating film is provided.

The heat insulating films increase the amount of the luminous substance which is vaporized. Consequently, the vapor pressure is increased and relighting of the discharge lamp is thereby improved.

Figure 15A:
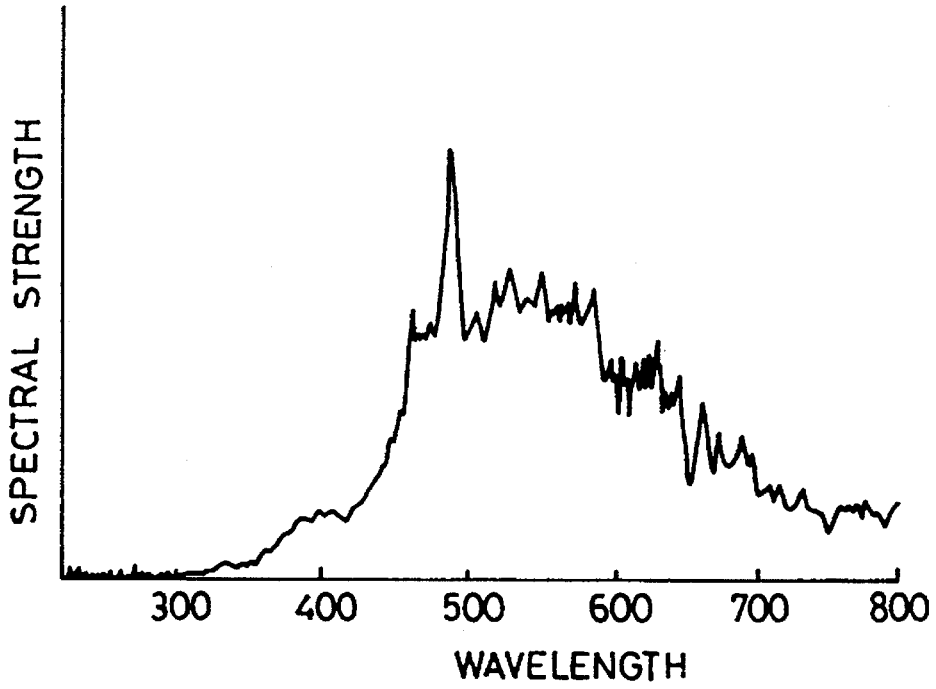
FIGS. 15A and 15B are diagrams to graphically 25 show output light spectrums in relation to the electrodeless discharge lamp of FIG. 14.
Figure 15B:
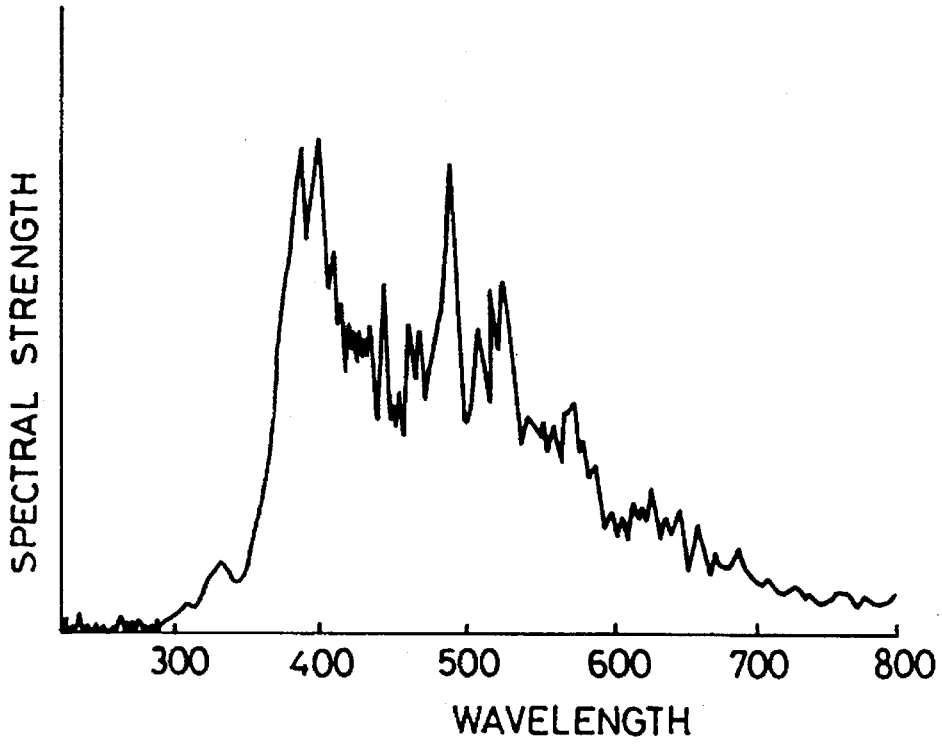

For example, when the lamp tube 121 has an outer diameter of 27 mm and contains 100 Torr of xenon gas, 15 mg of $NdI_3$ and 5 mg of CsI, an imput of 200 W produces an efficiency of 40 lm/W and a color temperature of 10,500K., when no heat insulating film is provided. By contrast, when a heat film is included, the lamp tube has an efficiency of 38 lm/W and a color temperature of 5,500K. Thus, the color temperature can be remarkably lowered without substantial loss in the efficiency by the inclusion of the heat insulating films. FIG. 15A is a graph showing optical output spectral strength with respect to wavelength for a lamp tube 121 which includes the heat insulating films 123 and **123*a*. FIG. 15B shows the optical output spectral strength with respect to the wavelength in the case where the lamp tube 121 has no heat insulating film. It will be appreciated when these figures are compared with each other, that the inclusion of the platinum heat insulating films 123 and 123*a*** is effective to raise the temperature inside the lamp tube to so as to reduce the output quantity of light at short wavelengths while lowering the color temperature.

Figure 16:
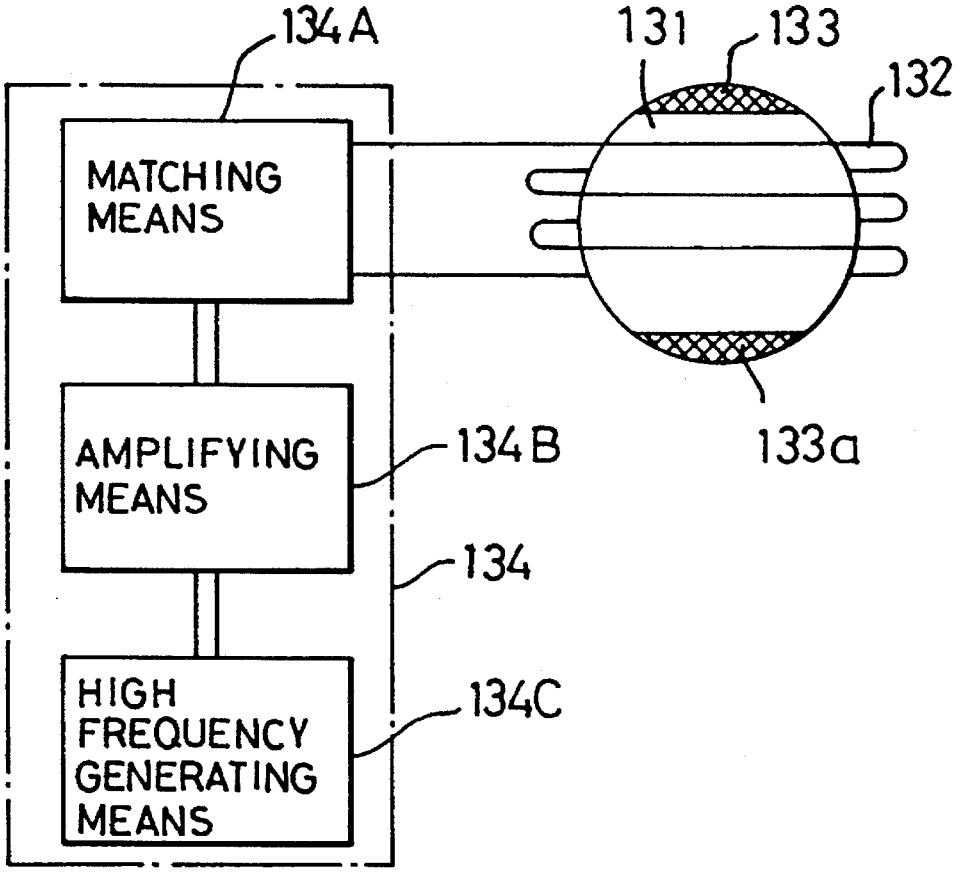
FIG. 16 shows in a schematic diagram an arrangement of the electrodeless discharge lamp in another embodiment of the present invention.

FIG. 16 shows another embodiment of the electrodeless discharge lamp including a lamp tube 131 having a electrically conducting films 133 and **133*a* provided at portions of the lamp tube where the induction coil 132 is not wound on the outer periphery. The electrically conducting films 133 and 133*a* are formed with a metallic film or foil of platinum, gold, copper or the like, or with a transparent- electrically conducting film as ITO, or with an electrically conducting ceramic film or the like. In this embodiment, high frequency power is supplied from the high frequency power source 134 to the induction coil 132. The luminous substances are affected by the high frequency electromagnetic field generated around the induction coil 132. This causes an excitation luminescence (plasma discharge) to take place, and induces a current to flow in the conducting films 133 and 133*a*. The conducting films 133 and 133*a* are heated due to a current loss occurring therein. Thus, the lamp tube 131** is heated which raises the temperature at the coldest portion of the tube. This improves the luminous efficiency of the lamp tube by increasing the amount of the luminous substances which are vaporized.

Figure 17A:
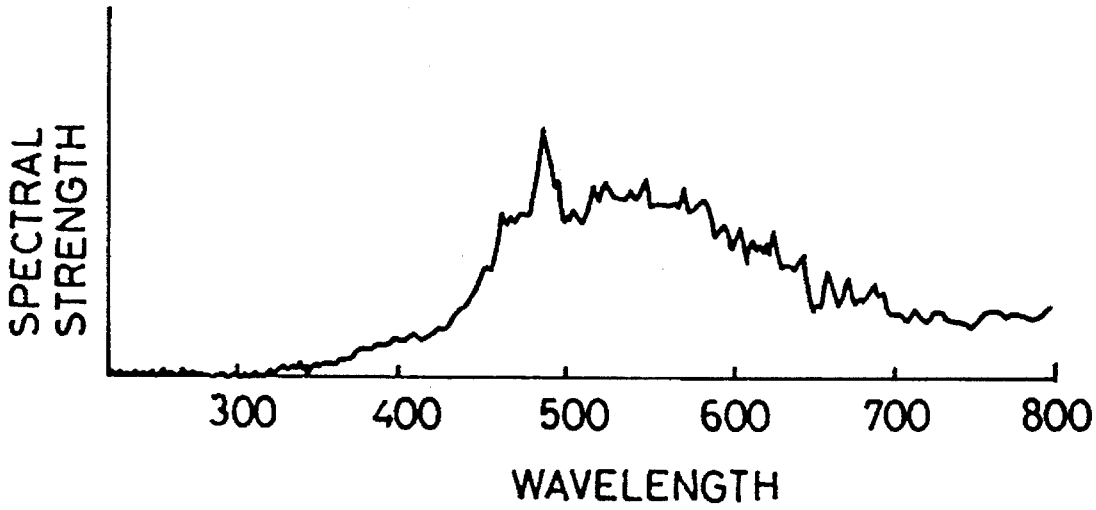
FIGS. 17A and 17B are diagrams for graphically showing output light spectrums in relation to the electrodeless discharge lamp of FIG. 16.
Figure 17B:
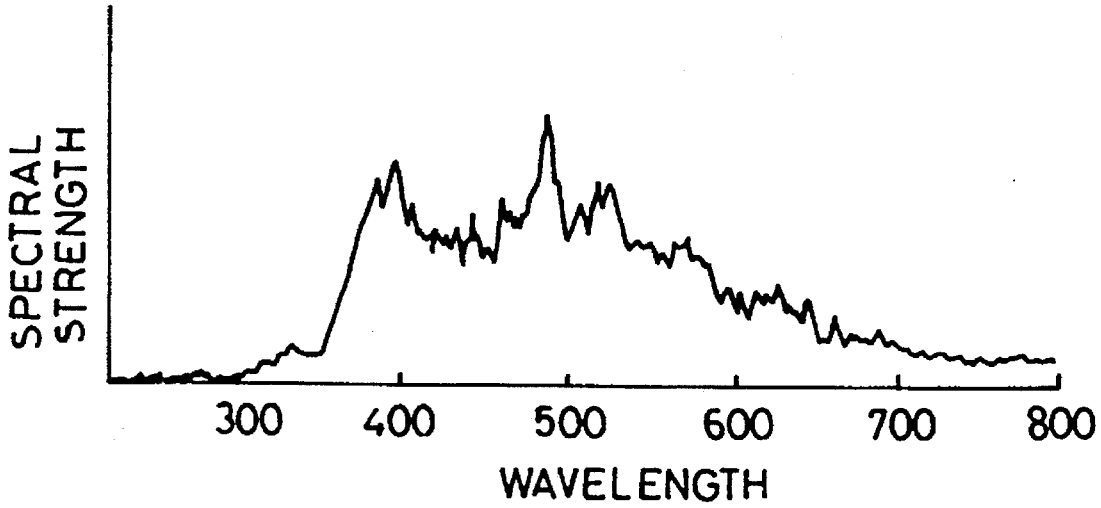

For example, a lamp tube 131 having 18 mm outer diameter filled with 100 Tort of xenon 15 mg of $NdI_3$ and 5 mg of CsI, and excited with an input of 150 W has an efficiency of 35 lm/w where no electrically conducting films 133 and **133*a* are provided. By contrast, a lamp tube having the same input and platinum conducting films 133 and 133*a*, has an efficiency of 45 lm/W. FIG. 17A shows a graph of the output spectral strength with respect to wavelength in the case where the conducting films 133 and 133***a* are provided while FIG. 17B shows the output spectral strength with respect to the wavelength where no conducting film is provided. As will be clear when both drawings are compared with each other, it has been found that the platinum electrically conducting films lower the quantity of output light on the short wavelength side.

Figure 18:
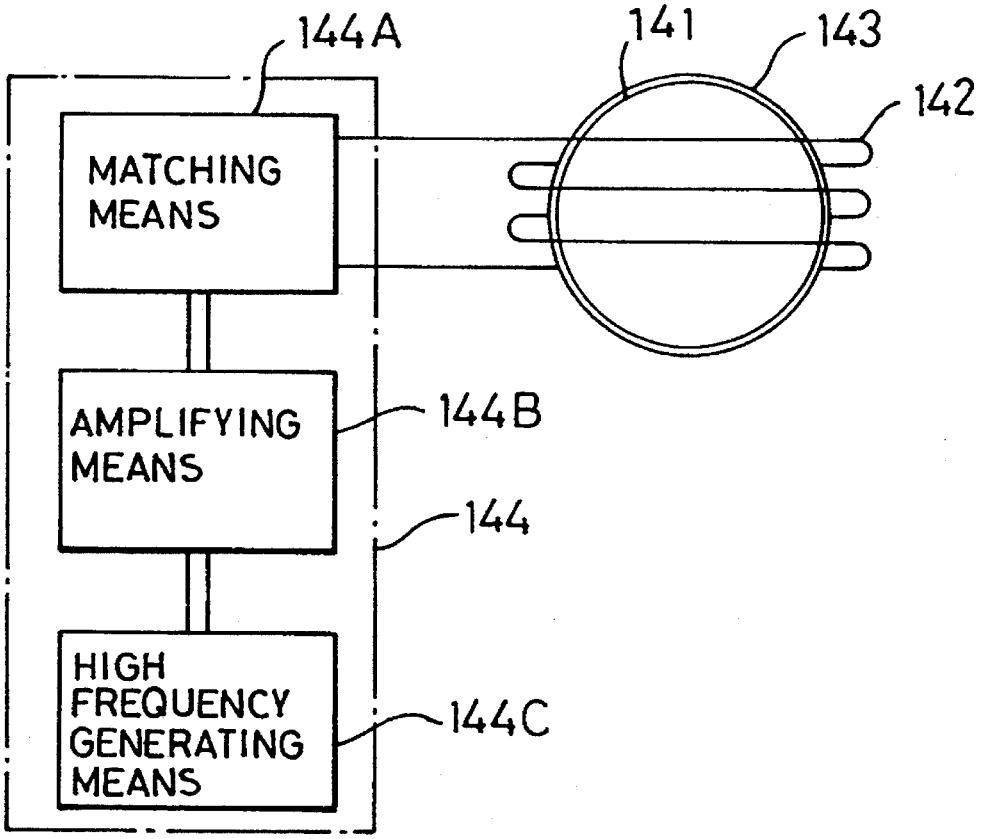
FIG. 18 is a schematic diagram showing the electrodeless discharge lamp in another embodiment of the present invention.
Figure 19:
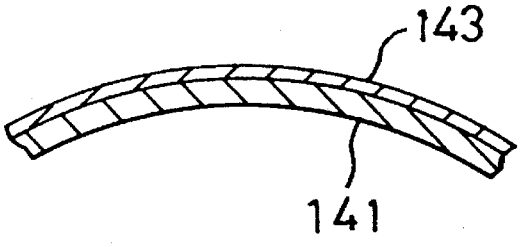
FIG. 19 is a schematic, fragmentary sectioned view of the lamp in the embodiment of FIG. 18.

Another embodiment of the electrodelees discharge lamp according to the present invention is shown in FIGS. 18 and 19. In this embodiment, the lamp tube 141 is covered with a light transmitting and heat conducting film 143 having a high thermal conductivity, such as a diamond film, preferably substantially all over the outer peripheral surface of the tube, as specifically shown in FIG. 19. In this embodiment, the induction coil 142 is supplied with the high frequency power from the high frequency power source 144. Luminous substances in the lamp tube are affected by the high frequency electromagnetic field generated around the induction coil 142 and cause the excitation luminescence (plasma discharge) to take place within the tube. Heat generated adjacent to the induction coil 142 reaches the highest temperature at the inner surface of the lamp tube 141 and is transmitted by the heat conducting film 143 to other lower temperature portions of the lamp tube. Whereby, in this manner, the temperature on the outer periphery of the lamp tube 141 is raised and hence the amount of the luminous substances vaporized is increased. Accordingly, the vapor pressure rises and the efficiency of light output of the lamp is improved.

For example, a lamp tube 141 having a 23 mm outer diameter tube filled with 100 Torr of xenon gas, and 20 mg of $NdI_3$-CsI (the luminous substances) and excited with an input of 25 OW has an efficiency of 63 lm/W when no heat conducting film is provided. By contrast, when a diamond film of 2 μm thick was utilized a heat conducting film 143 on the tube, the efficiency with the game input of 25 0W was 76 lm/W. In this case, the heat conductivity of diamond is 2,000 W/m.K, which is more than 10 times as high as that of the silica glass used in the lamp tube 141. Further, the diamond film is substantially transparent, attenuation of the light flux, and is therefor an excellent material for forming the heat conducting film 143. The heat conducting film 143 may also utilized a material having characteristics approximating those of diamond such as beryllium oxide, aluminum nitride, silicon carbide or the like. The heat conducting film 143 may be formed on the lamp tube using various methods such as an ionization metallizing method, a hot filament CVD method, a plasma CVD method as well as other methods.

Measurements of wall temperatures of a lamp tube 141 covered with a diamond heat conducting film 143 demonstrated that the temperature at a portion close to the induction coil 142 and where plasma is generated is lowered by about 150° C. as compared with a lamp tube having no heat conducting film. Similarly, the temperature at the coldest portion of the lamp tube increase by about 120° C. in contrast to a lamp tube without the heat conducting film. Raising the temperature at the colder portions increases the luminous efficiency while reducing the thermal load applied to the lamp tube 141 by reducing the temperature at the hotter portions. Further, when the heat conducting film 143 was made by beryllium oxide, the luminous efficiency was 70 lm/W with an input of 25 0W. This embodiment lowered the temperature at the portion close to the induction coil 142 where plasma would be generated by about 590° C. and increased the temperature at the coldest portion of the lamp tube by about 80° C. Accordingly, other heat conducting films may function close to that of the diamond film.

Figure 20:
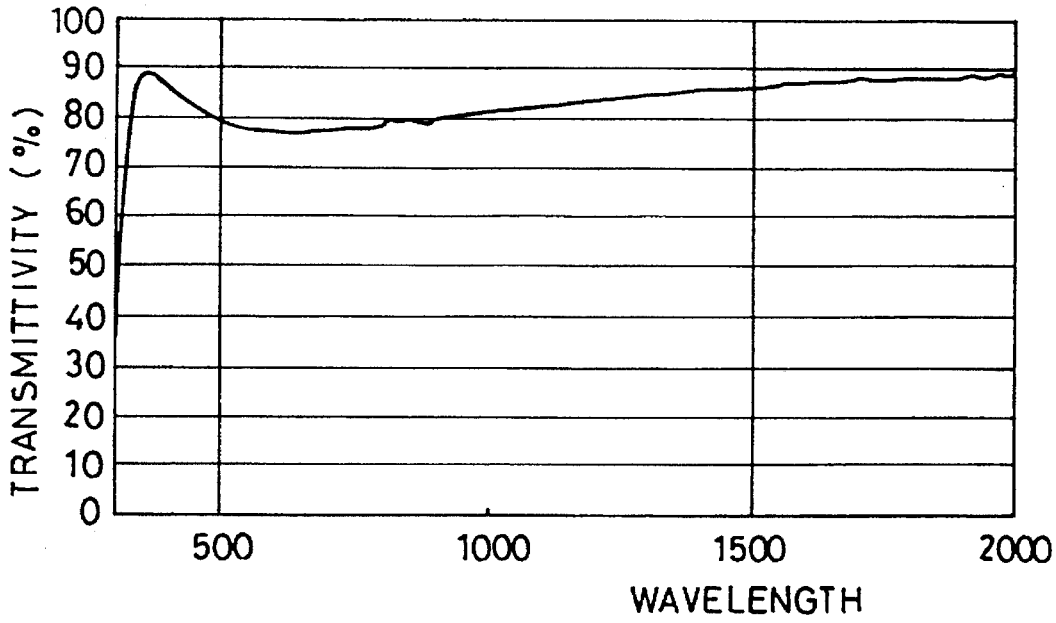
FIG. 20 is a graph showing transmittivity characteristics of a film member employed in still another embodiment of the electrodeless discharge lamp according to the present invention.
Figure 21:
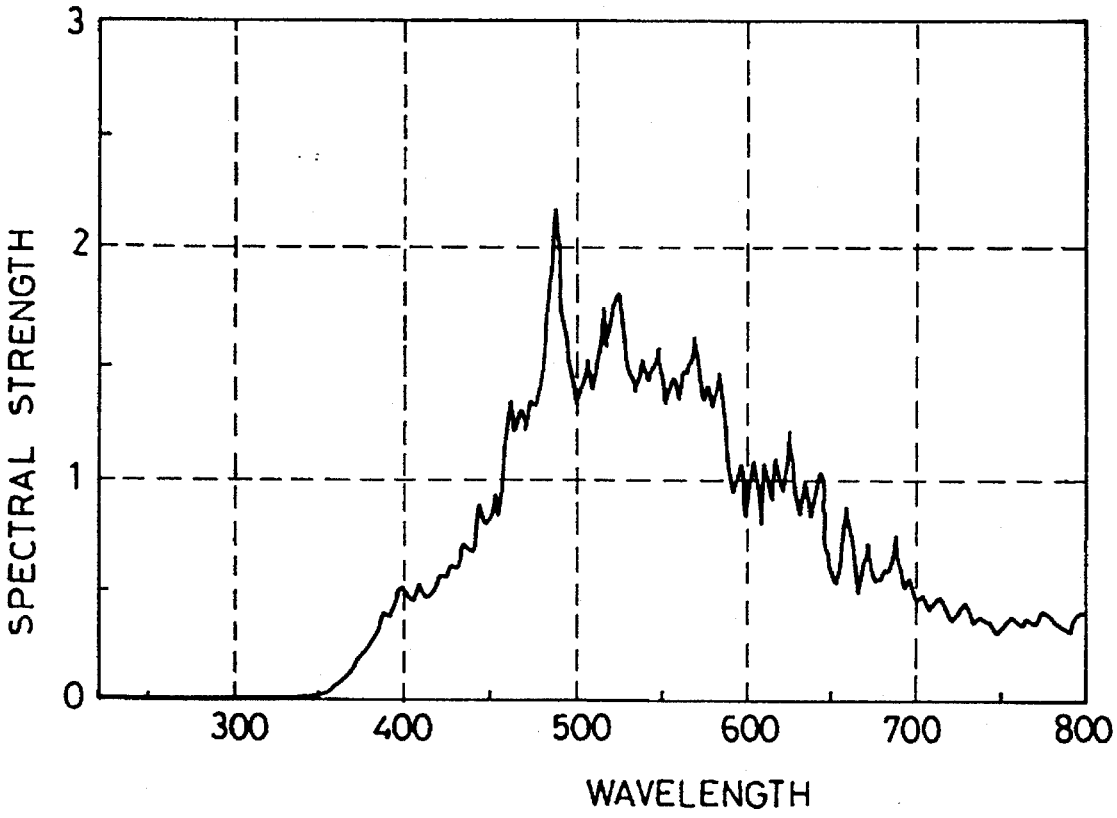
FIG. 21 is a diagram for graphically showing an output light spectrum in relation to the electrodeless discharge lamp showing the characteristics of FIG. 20.

In another working aspect according to the 10 present invention, a barium titanate film is provided to cover the whole of the outer periphery of the lamp tube. For example, a lamp tube having a cylindrical shape of 23 mm in diameter and 15 mm in height, was filled with 100 Torr of xenon gas, 15 mg of $NdI_3$ and 5 mg of CsI (as the luminous substance). Where the tube was not covered by the barium titanate film, the luminous efficiency was 63 1 m/w with the input of 200 W and the temperature at the coldest portion was about 680° C. By contrast, where the tube was covered with the barium titanate film, the efficiency was 70 lm/W with the same input, and the temperature at the coldest portion was about 710° C. Thus, the heat insulating film remarkably improved the characteristics of the lamp tube. Additionally, as shown in FIG. 20, the barium titanate film has excellent light transmission. Further, as shown in FIG. 21, the optical output spectral strength with respect to the wavelength is excellent, as would be clear when compared with FIGS. 15A and 17A.

In the foregoing embodiments of the electrodeless discharge lamp as shown in FIGS. 14, 16 and 18, whale not specifically described, there is provided a preliminary discharge means including the auxiliary electrode to which the second high frequency power source supplies the electric power for generating the preliminary discharge to improve stability in a similar manner as the earlier described embodiments. It will be also appreciated that all other constituents of the embodiments shown in FIGS. 13, 14, 16 and 18 than those referred to are the same as those in the earlier described embodiments, and the same functions are attainable.

In the electrodelees discharge lamp according to the present invention, the concurrent use of a halide of a rare earth metal in the lamp tube and the preliminary discharge means including the auxiliary electrode secured to the lamp tube has brought about a remarkable distinction when compared to conventional electrodeless discharge lamps not provided with the preliminary discharge means though employing the halide of rare earth metal. This distinction is shown in the following table:

TABLE

| | Fill | Starting Time | Restarting Time |
|---|---|---|---|
| Present Invention | $NdI_3$-CsI, Xe | 2 m.sec. | 2 m.sec. |
| | NaI-TlI-Ini, Xe | 2 m.sec. | 35 sec. |
| No Prelim. Dis. | $NdI_3$-CsI, Xe | Not Started | Not Started |
| Means Employed | NaI-TlI-InI, Xe | Not Started | Not Started |

For the starting and restarting time in the above table, the voltage across the induction coil has been measured. Here, the term "starting" means to start the discharge lamp after more than ten hours in the non-lighted state, while the term "restarting" means to light the discharge lamp immediately after the turning-off a stably lighted discharge lamp. Further, "Not Started" indicates that the discharge lamp has not started even upon application of the voltage of 3.0 kV across the induction coil.

Further, the present invention allows a variety of design modifications. While, for example, the auxiliary electrode of the preliminary discharge means has been referred to as being single in the foregoing embodiments, it is possible to provide a pair of the preliminary electrodes opposing each other on the outer periphery of the lamp tube along the zone around which the induction coil is wound. It is also possible to employ three or more of the auxiliary electrodes as disposed on the lamp tube. Instead of providing the second high frequency power source for use with the auxiliary electrode, the power feeding can be performed with the first high frequency power source only but adapted to be used in common to the induction coil and the auxiliary electrode.

What is claimed is:

1. An electrodeless discharge lamp comprising:

a lamp tube having an outer peripheral wall including a light-transmitting material and defining an interior space within the lamp tube;

a discharge gas sealed within the interior space of the lamp tube and including a halide of a rare earth metal;

an induction coil wound around the lamp tube for generating a high frequency electromagnetic field acting upon the discharge gas in the lamp tube;

a first high frequency power source for supplying a high frequency current to the induction coil;

preliminary discharge means including a foil auxiliary electrode provided adjacent to the outer peripheral wall of the lamp tube at a position substantially the same distance from points around the induction coil along an axial line running through the induction coil, the auxiliary electrode being electrostatically coupled to the interior space of the lamp tube for causing a preliminary discharge of the discharge gas in the lamp tube generated prior to a plasma discharge luminescence by means of the induction coil; and a second high frequency power source for applying a high frequency voltage to the auxiliary electrode wherein the outer peripheral wall of the lamp tube is entirely covered with a barium titanate film, thereby controlling a color shift.

2. An electrodeless discharge lamp comprising:

a lamp tube having an outer peripheral wall including a light-transmitting material and defining an interior space within the lamp tube;

a discharge gas sealed within the interior space of the lamp tube and including a halide of a rare earth metal;

an induction coil wound around the lamp tube for generating a high frequency electromagnetic field acting upon the discharge gas in the lamp tube;

a first high frequency power source for supplying a high frequency current to the induction coal;

preliminary discharge means including a foil type auxiliary electrode provided adjacent to the outer peripheral wall of the lamp tube at a position substantially the same distance from points around the induction coil along an axial line running through the induction coil, the auxiliary electrode being electrostatically coupled to the interior space of the lamp tube for causing a preliminary discharge of the discharge gas in the lamp tube generated prior to a plasma discharge luminescence by means of the induction coil; and a second high frequency power source for applying a high frequency voltage to the auxiliary electrode wherein an electrically conducting film is disposed on the outer peripheral wall of the lamp tube except for a portion of the outer peripheral wall adjacent to the induction coil for being inductively heated by the high frequency electromagnetic field of the induction coil, thereby heating the lamp tube.

3. The discharge lamp according to claim 2 wherein the electrically conducting film is selected from the group consisting of gold, silver, and platinum.

4. The discharge lamp according to claim 2 wherein the outer peripheral wall of the lamp tube is entirely covered with a heat conducting film having a high thermal conductivity for conducting heat from high temperature regions of the lamp tube to lower temperature regions of the lamp tube.

5. An electrodeless discharge lamp comprising, in combination:

a lamp tube having an outer peripheral wall including a light-transmitting material and defining an interior space within the lamp tube;

a discharge gas sealed within the interior space of the lamp tube, the discharge gas including a mixture of rare gas and a halide of a rare earth metal;

an induction coil wound around the lamp tube for generating a high frequency electromagnetic field acting upon the discharge gas in the lamp tube;

a first high frequency power source for supplying a high frequency current to the induction coil;

preliminary discharge means in permanent contact with the outer peripheral wall of the lamp tube and electrostatically coupled to the interior space of the lamp tube for causing a preliminary discharge of the discharge gas in the lamp tube generated prior to a plasma discharge luminescence generated by means of the induction coil;

a second high frequency power source for applying a high frequency voltage to the auxiliary electrode, the preliminary discharge means and the mixture of a rare gas and a halide of a rare earth metal combining to provide means for reducing the time necessary for starting and restarting the plasma discharge luminescence; and an electrically conducting film disposed on the outer peripheral wall of the lamp tube except for a portion of the outer peripheral wall adjacent to the induction coil, the electrically conducting film being positioned relative to the induction coil and inductively heated by the induction coil, thereby heating the lamp tube.

6. An electrodeless discharge lamp comprising, in combination:

a lamp tube having an outer peripheral wall including a light-transmitting material and defining an interior space within the lamp tube;

a discharge gas sealed within the interior space of the lamp tube, the discharge gas including a mixture of rare gas and a halide of a rare earth metal;

an induction coil wound around the lamp tube for generating a high frequency electromagnetic field acting upon the discharge gas in the lamp tube;

a first high frequency power source for supplying a high frequency current to the induction coil;

preliminary discharge means in permanent contact with the outer peripheral wall of the lamp tube and electrostatically coupled to the interior space of the lamp tube for causing a preliminary discharge of the discharge gas in the lamp tube generated prior to a plasma discharge luminescence generated by means of the induction coil; and a second high frequency power source for applying a high frequency voltage to the auxiliary electrode, the preliminary discharge means and the mixture of a rare gas and a halide of a rare earth metal combining to provide means for reducing the time necessary for starting and restarting the plasma discharge luminescence wherein the outer peripheral wall of the lamp tube is entirely covered with a heat conducting film of a high thermal conductivity for conducting heat from high temperature regions of the lamp tube to lower temperature regions of the lamp tube, thereby controlling a color shift.

7. The discharge lamp according to claim 6 wherein the heat conducting film includes barium titanate.

* * * * *